US008525447B2

(12) United States Patent
Antaya

(10) Patent No.: US 8,525,447 B2
(45) Date of Patent: Sep. 3, 2013

(54) COMPACT COLD, WEAK-FOCUSING, SUPERCONDUCTING CYCLOTRON

(75) Inventor: Timothy A. Antaya, Hampton Falls, NH (US)

(73) Assignee: Massachusetts Institute of Technology, Cambridge, MA (US)

( * ) Notice: Subject to any disclaimer, the term of this patent is extended or adjusted under 35 U.S.C. 154(b) by 230 days.

(21) Appl. No.: 12/951,968

(22) Filed: Nov. 22, 2010

(65) Prior Publication Data

US 2012/0126726 A1 May 24, 2012

(51) Int. Cl.
*H05H 13/00* (2006.01)

(52) U.S. Cl.
USPC ..... 315/502; 315/505; 335/216

(58) Field of Classification Search
USPC ..... 315/502
See application file for complete search history.

(56) References Cited

U.S. PATENT DOCUMENTS

| | | | | |
|---|---|---|---|---|
| 1,948,384 | A | 2/1934 | Lawrence | |
| 3,175,131 | A | 3/1965 | Burleigh et al. | |
| 4,641,057 | A | 2/1987 | Blosser et al. | |
| 4,968,915 | A | 11/1990 | Wilson et al. | |
| 6,683,426 | B1 * | 1/2004 | Kleeven | 315/502 |
| 7,541,905 | B2 | 6/2009 | Antaya | |
| 7,656,258 | B1 | 2/2010 | Antaya et al. | |
| 7,696,847 | B2 | 4/2010 | Antaya | |
| 2007/0101742 | A1 * | 5/2007 | Laskaris et al. | 62/259.2 |
| 2009/0206967 | A1 * | 8/2009 | Antaya | 335/216 |
| 2010/0148895 | A1 | 6/2010 | Antaya et al. | |

FOREIGN PATENT DOCUMENTS

EP 1 069 809 A1 1/2001

OTHER PUBLICATIONS

Bigham, Magnetic Trim Rods for Superconducting Cyclotrons, Nuclear Instruments and Methods, 1975, pp. 223-228.*
Dey et al., Design of the Proposed 250 MeV Superconducting Cyclotron Magnet, APAC 2007, Raja Ramana Centre for Advanced Technology (RRCAT), 2007, pp. 661-663.*
Kubo et al., Design of Model Sector Magnet for the RIKEN Superconducting Ring Cyclotron, PAC 1997 Vancouver, vol. 3, 1997, pp. 3428-3430.*
Mitsumoto et al., Design Study of Sector Magnet for the RIKEN Superconducting Ring Cyclotron (I), EPAC, 1996, pp. 1-3.*
Kim, Jong-Won, "A Eight-Tesla Superconducting Magnet for Cyclotron Studies," PhD Dissertation, Michigan State University, vol. 55-12, Section: B, p. 5399 (1994).
Wu, Xiaoyu, "Conceptual Design and Orbit Dynamics in a 250 Mev Superconducting Synchrocyclotron", PhD Dissertation, Michigan State University, vol. 52-05, Section: B, p. 2619 (1991).

(Continued)

*Primary Examiner* — Jerome Jackson, Jr.
*Assistant Examiner* — David Lotter
(74) *Attorney, Agent, or Firm* — Modern Times Legal; Robert J. Sayre

(57) ABSTRACT

A compact, cold, weak-focusing superconducting cyclotron can include at least two superconducting coils on opposite sides of a median acceleration plane. A magnetic yoke surrounds the coils and contains an acceleration chamber. The magnetic yoke is in thermal contact with the superconducting coils, and the median acceleration plane extends through the acceleration chamber. A cryogenic refrigerator is thermally coupled both with the superconducting coils and with the magnetic yoke.

24 Claims, 7 Drawing Sheets

(56) References Cited

OTHER PUBLICATIONS

European Patent Office, International Search Report and Written Opinion for PCT/US2011/058750 (corresponding PCT application) (May 30, 2012).

Kubo, et al., "Design of a model sector magnet for the RIKEN superconductor ring cyclotron", PAC 1997 Vancouver, vol. 3, 3428-3430 (May 15, 1997).

Mitsumoto, et al., "Design study of sector magnet for the RIKEN superconducting ring cyclotron (I)", 5th European Particle Accelerator Conference, EPAC'96 (Jun. 11, 1996).

Daniel, et al., "Design status of the Munich cyclotron SUSE", IEEE Transactions on Nuclear Science, vol. 28, No. 3, 2107-09 (Jun. 1981).

Bigham, C. B., "Magnetic trim rods for superconducting cyclotrons", Nuclear Instruments and Methods, North-Holland, vol. 131, No. 2, 223-228 (Dec. 24, 1975).

* cited by examiner

COMPACT COLD, WEAK-FOCUSING, SUPERCONDUCTING CYCLOTRON

BACKGROUND

A cyclotron for accelerating ions (charged particles) in an outward spiral using an electric field impulse from a pair of electrodes and a magnet structure is disclosed in U.S. Pat. No. 1,948,384 (inventor: Ernest O. Lawrence, patent issued: 1934). Lawrence's accelerator design is now generally referred to as a "classical" cyclotron, wherein the electrodes provide a fixed acceleration frequency, and the magnetic field decreases with increasing radius, providing "weak focusing" for maintaining the vertical phase stability of the orbiting ions.

Modern cyclotrons are primarily of a class known as "isochronous" cyclotrons, wherein the acceleration frequency provided by the electrodes is likewise fixed, though the magnetic field increases with increasing radius to compensate for relativity; and an axial restoring force is applied during ion acceleration via an azimuthally varying magnetic field component derived from contoured iron pole pieces having a sector periodicity. Most isochronous cyclotrons use resistive magnet technology and operate at magnetic field levels from 1-3 Tesla. Some isochronous cyclotrons use superconducting magnet technology, in which superconducting coils magnetize warm iron poles that provide the guide and focusing fields required for acceleration. These superconducting isochronous cyclotrons operate at field levels from 3-5T. The present inventor worked on the first superconducting cyclotron project in the early 1980s at Michigan State University.

Cyclotrons of another class are known as synchrocyclotrons. Unlike classical cyclotrons or isochronous cyclotrons, the acceleration frequency in a synchrocyclotron decreases as the ion spirals outward. Also unlike isochronous cyclotrons, though like classical cyclotrons, the magnetic field in a synchrocyclotron decreases with increasing radius. The present inventor recently invented a high-field synchrocyclotron (described in U.S. Pat. Nos. 7,541,905 B2 and 7,696,847 B2) for proton beam radiotherapy and other clinical applications. Embodiments of this synchrocyclotron have warm iron poles and cold superconducting coils, like the existing superconducting isochronous cyclotrons, but maintain beam focusing during acceleration in a different manner that scales to higher fields and can accordingly operate with a field of, for example, about 9 Tesla.

SUMMARY

A compact, cold, weak-focusing, superconducting cyclotron is described herein. Various embodiments of the apparatus and methods for its construction and use may include some or all of the elements, features and steps described below.

The compact, cold, weak-focusing, superconducting cyclotron can include at least two superconducting coils on opposite sides of a median acceleration plane. A magnetic yoke surrounds the coils and contains an acceleration chamber. The magnetic yoke is in thermal contact with the thermal link from a cryogenic refrigerator and with the superconducting coils, and the median acceleration plane extends through the acceleration chamber.

During operation of the cyclotron, an ion is introduced into the median acceleration plane at an inner radius. A radiofrequency voltage from a radiofrequency voltage source is applied to a pair of electrodes mounted inside the magnetic yoke to accelerate the ion in an expanding orbit across the median acceleration plane. The superconducting coils and the magnetic yoke are cooled by the cryogenic refrigerator to a temperature no greater than the superconducting transition temperature of the superconducting coils. A voltage is supplied to the cooled superconducting coils to generate a superconducting current in the superconducting coils that produces a magnetic field in the median acceleration plane from the superconducting coils and from the yoke; and the accelerated ion is extracted from the acceleration chamber when it reaches an outer radius.

The cyclotron can be of a classical design, building on the original weak-focusing cyclotron of E. O. Lawrence, which has fixed frequency (like the isochronous cyclotron) and a simple magnetic circuit (like the synchrocyclotron). To make the classical cyclotron scale to high fields, the entire magnet (yoke and coils) can be cooled to cryogenic temperatures during operation, while space and clearances are preserved for warm acceleration components to reside inside the magnetic yoke. This cold-iron, weak-focusing cyclotron can be scaled to such high fields with reduced size to enable its use as a portable cyclotron device. Such cyclotrons may be restricted to energies of less than 25 MeV for protons, but most cyclotrons built for applications are in this energy range, and there exists a number of industrial and defense applications that would be enabled for practical use by the existence of such a cyclotron.

The compact, cold, weak-focusing, superconducting cyclotron can include a simple cylindrical cryostat with a slotted warm penetration through the mid-section of the cyclotron. The cold components inside the cyclotron may be cooled via any number of manners, for example, directly by mechanical cryogenic refrigeration, by a thermo-siphon circuit employing a mechanical cooler, by continuous supply of liquid cryogens, or by a static charge of pool boiling cryogens. The operating temperature of the cyclotron can be from 4K to 80K and may be dictated by the superconductor selected for the coils.

The entire magnet, including coils, poles, the return-path iron yoke, trim coils, permanent magnets, shaped ferromagnetic pole surfaces, and fringe-field canceling coils or materials can be mounted on a single simple thermal support, installed in a cryostat and held at the operating temperature of the superconducting coils. The cyclotron accelerator structure (e.g., the ion source and the electrodes) can be entirely within the external warm central slot in the cryostat and can therefore be both thermally and mechanically isolated from the cold superconducting magnet. This design is believed to represent a fundamentally new electromechanical structure for a cyclotron of any type. The magnet here is designed to provide the required acceleration and focusing fields in the warm slot for the operation of weak-focusing, fixed-frequency cyclotron acceleration of all positive ion species at 25 MeV or less.

Because there is no gap between the yoke and the coils, there is no need for a separate mechanical support structure for the coils to mitigate the large decentering forces that are encountered at high field in the existing superconducting cyclotrons, and decentering forces can be uniquely eliminated. The cold magnet materials of the magnetic yoke can be used simultaneously to shape the field and to structurally support the superconducting coils, further reducing the complexity and increasing the intrinsic safety of the cyclotron. Moreover, with all of the magnet contained inside the cryostat, the external fringe field may be cancelled without adversely affecting the acceleration field, either by cancellation superconducting coils or by cancellation superconducting surfaces affixed to intermediate temperature shields within the cryostat.

The cyclotron designs, described herein, can offer a number of additional advantages both over existing superconducting isochronous cyclotrons and over existing superconducting synchrocyclotrons, which are already more compact and less expensive than conventional equivalents. For example, the magnet structure can be simplified because there is no need for separate support structures to maintain the force balance between constituents of the magnetic circuit, which can reduce overall cost, improve overall safety, and reduce the need for space and active protection systems to manage the external magnetic field. Additionally, the cyclotrons can produce a high magnetic field (e.g., about 8 Tesla) without a need for a complex variable-frequency acceleration system, since the classical design of these cyclotrons can operate on a fixed acceleration frequency. Accordingly, the cyclotrons of this disclosure can be used in mobile contexts and in smaller confines.

Preliminary studies suggest that these cyclotrons can offer a factor of 100 or more reduction in size over conventional cyclotrons at these energies, and these cyclotrons accordingly can be portably utilized in a widely distributed manner, including at remote field locations, as well as at ports and airports, for aerial and submarine reconnaissance, and for explosive and nuclear threat detection.

BRIEF DESCRIPTION OF THE DRAWINGS

In the accompanying drawings, like reference characters refer to the same or similar parts throughout the different views. The drawings are not necessarily to scale, emphasis instead being placed upon illustrating particular principles, discussed below.

DETAILED DESCRIPTION

Figure 1:
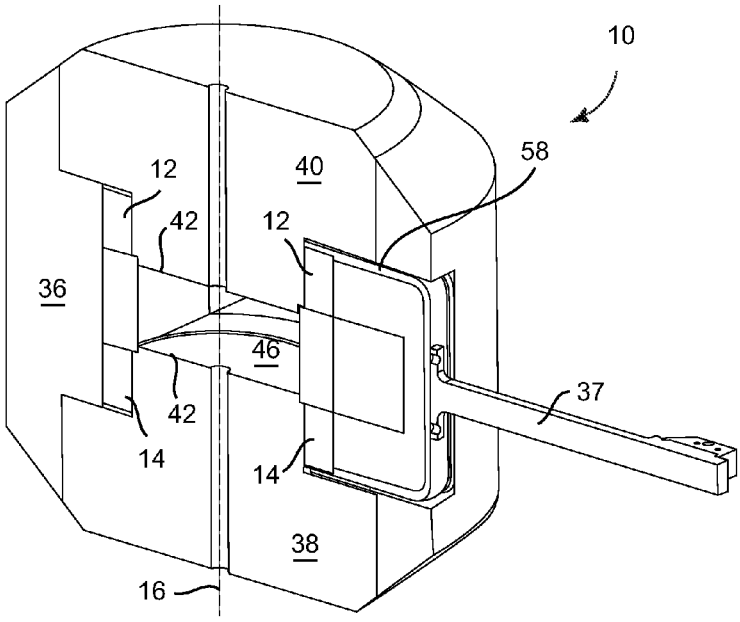
FIG. 1 is a sectioned view of an embodiment of a compact, cold, weak-focusing, superconducting cyclotron, without showing a custom-engineered profile on the inner surfaces of the poles.

The foregoing and other features and advantages of various aspects of the invention(s) will be apparent from the following, more-particular description of various concepts and specific embodiments within the broader bounds of the invention(s). Various aspects of the subject matter introduced above and discussed in greater detail below may be implemented in any of numerous ways, as the subject matter is not limited to any particular manner of implementation. Examples of specific implementations and applications are provided primarily for illustrative purposes.

Unless otherwise defined, used or characterized herein, terms that are used herein (including technical and scientific terms) are to be interpreted as having a meaning that is consistent with their accepted meaning in the context of the relevant art and are not to be interpreted in an idealized or overly formal sense unless expressly so defined herein. For example, if a particular composition is referenced, the composition may be substantially, though not perfectly pure, as practical and imperfect realities may apply; e.g., the potential presence of at least trace impurities (e.g., at less than 1 or 2% by weight or volume) can be understood as being within the scope of the description; likewise, if a particular shape is referenced, the shape is intended to include imperfect variations from ideal shapes, e.g., due to machining tolerances.

Spatially relative terms, such as "above," "upper," "beneath," "below," "lower," and the like, may be used herein for ease of description to describe the relationship of one element to another element, as illustrated in the figures. It will be understood that the spatially relative terms are intended to encompass different orientations of the apparatus in use or operation in addition to the orientation depicted in the figures. For example, if the apparatus in the figures is turned over, elements described as "below" or "beneath" other elements or features would then be oriented "above" the other elements or features. Thus, the exemplary term, "above," may encompass both an orientation of above and below. The apparatus may be otherwise oriented (e.g., rotated 90 degrees or at other orientations) and the spatially relative descriptors used herein interpreted accordingly.

Further still, in this disclosure, when an element is referred to as being "on," "connected to" or "coupled to" another element, it may be directly on, connected or coupled to the other element or intervening elements may be present unless otherwise specified.

The terminology used herein is for the purpose of describing particular embodiments and is not intended to be limiting of exemplary embodiments. As used herein, the singular forms, "a," "an" and "the," are intended to include the plural forms as well, unless the context clearly indicates otherwise. Additionally, the terms, "includes," "including," "comprises" and "comprising," specify the presence of the stated elements or steps but do not preclude the presence or addition of one or more other elements or steps.

In general terms, cyclotrons are members of the circular class of particle accelerators. The beam theory of circular particle accelerators is well-developed, based upon the concepts of equilibrium orbits and betatron oscillations around equilibrium orbits. The principle of equilibrium orbits (EOs) can be described as follows:

- a charged ion of given momentum captured by a magnetic field will transcribe an orbit;
- closed orbits represent the equilibrium condition for the given charge, momentum and energy of the ion;
- the field can be analyzed for its ability to carry a smooth set of equilibrium orbits; and
- acceleration can be viewed as a transition from one equilibrium orbit to another.

Meanwhile, the weak-focusing principle of perturbation theory can be described as follows:

- the particles oscillate about a mean trajectory (also known as the central ray);
- oscillation frequencies ($v_r$, $v_z$) characterize motion in the radial (r) and axial (z) directions, respectively;
- the magnet field is decomposed into coordinate field components and a field index (n); and $v_r=\sqrt{1-n}$, while $v_z=\sqrt{n}$; and
- resonances between particle oscillations and the magnetic field components, particularly field error terms, determine acceleration stability and losses.

The weak-focusing field index parameter, n, noted above, is defined as follows:

$$n = -\frac{r}{B}\frac{dB}{dr},$$

where r is the radius of the ion from the central axis 16, as shown in the sectioned illustration of a compact cyclotron in FIG. 1; and B is the magnitude of the axial magnetic field at that radius. The weak-focusing field index parameter, n, is in the range from zero to one across the entirety of the section of the median acceleration plane (shown in FIG. 3) within the acceleration chamber 46 over which the ions are accelerated (with the possible exception of the central region of the chamber proximate the central axis 16, where the ions are introduced and where the radius is nearly zero) to enable the successful acceleration of ions to full energy in a cyclotron in which the field generated by the coils dominates the field index. In particular, a restoring force is provided during acceleration to keep the ions oscillating with stability about the mean trajectory. One can show that this axial restoring force exists when n>0, and this condition requires that dB/dr<0 since B>0 and r>0. The cyclotron has a field that decreases with radius to match the field index required for acceleration.

Figure 2:
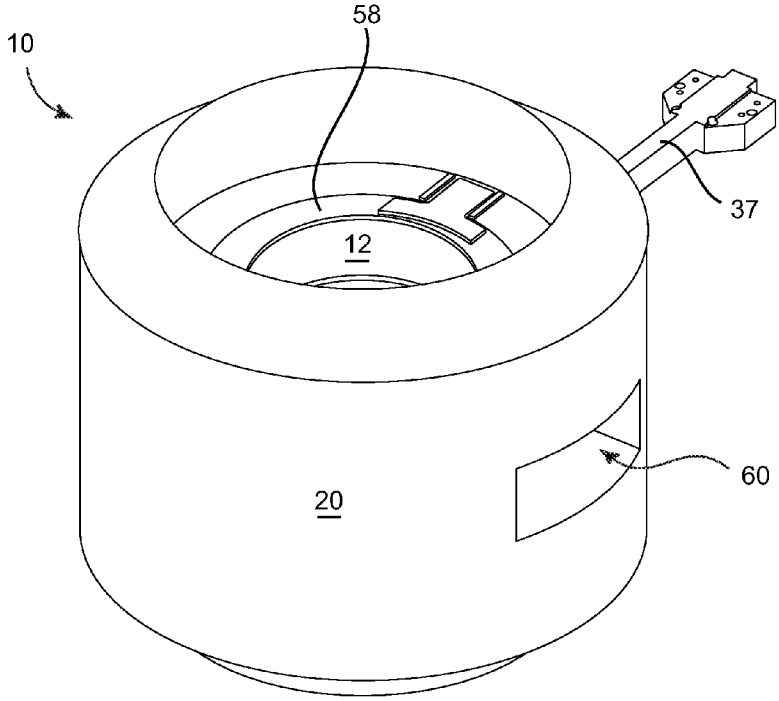
FIG. 2 is a perspective view of the cyclotron of FIG. 1.
Figure 3:
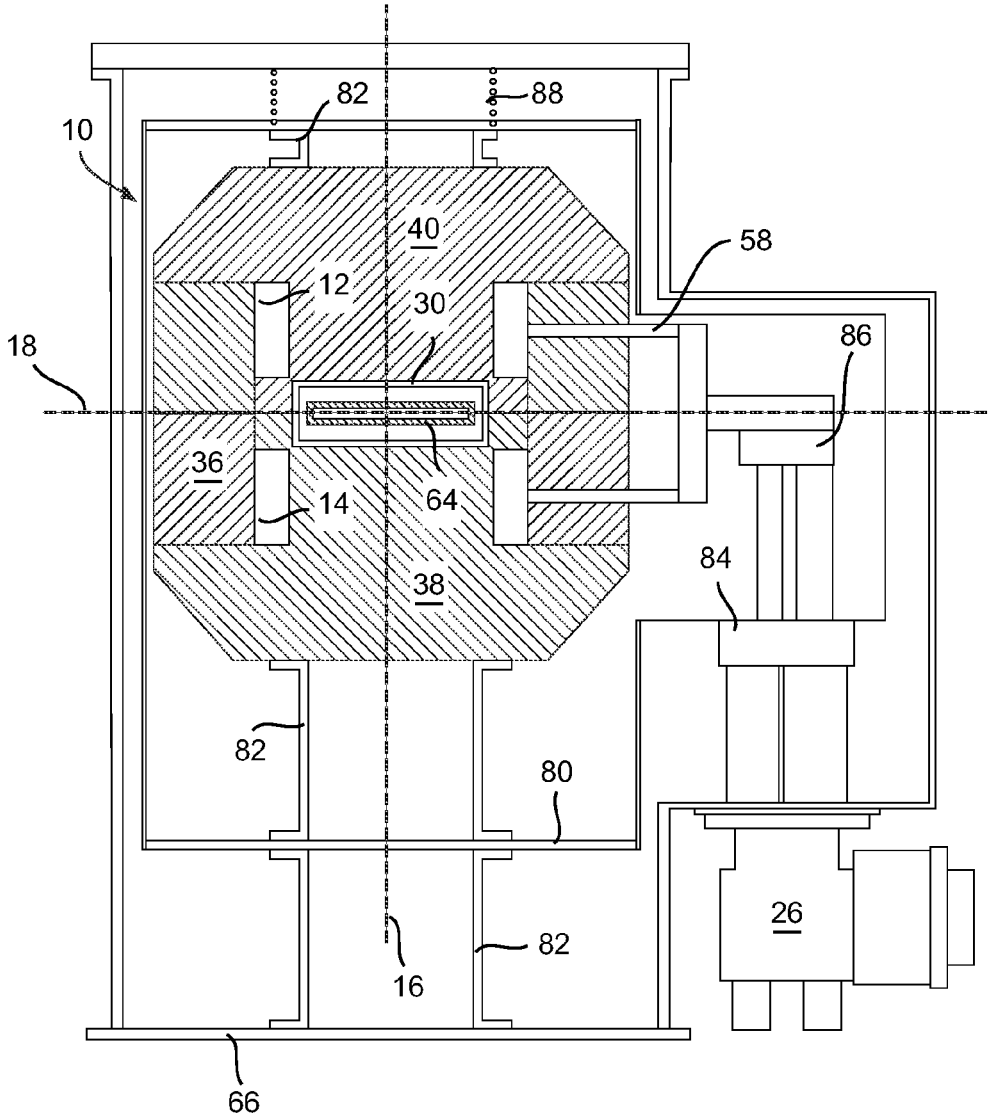
FIG. 3 is a side sectional view of an embodiment of the compact, cold, weak-focusing, superconducting cyclotron with a series of cryostats and a cryogenic refrigerator.

The magnet structure 10, as shown in FIGS. 1 and 2, includes a magnetic yoke 20 with a pair of poles 38 and 40 and a return yoke 36 that define an acceleration chamber 46 with a median acceleration plane 18 for ion acceleration. As shown in FIG. 3, the magnet structure 10 is supported and spaced by structural spacers 82 formed of an insulating composition, such as an epoxy-glass composite, and contained within an outer cryostat 66 (formed, e.g., of stainless steel or low-carbon steel and providing a vacuum barrier within the contained volume) and a thermal shield 80 (formed, e.g., of copper or aluminum). A compression spring 88 holds the 80K thermal shield 80 and magnet structure 10 in compression.

A pair of magnetic coils 12 and 14 (i.e., coils that can generate a magnetic field) are contained in and in contact with the yoke 20 (i.e., without being fully separated by a cryostat or by free space) such that the yoke 20 provides support for and is in thermal contact with the magnetic coils 12 and 14. Consequently, the magnetic coils 12 and 14 are not subject to decentering forces, and there is no need for tension links to keep the magnetic coils 12 and 14 centered.

Figure 5:
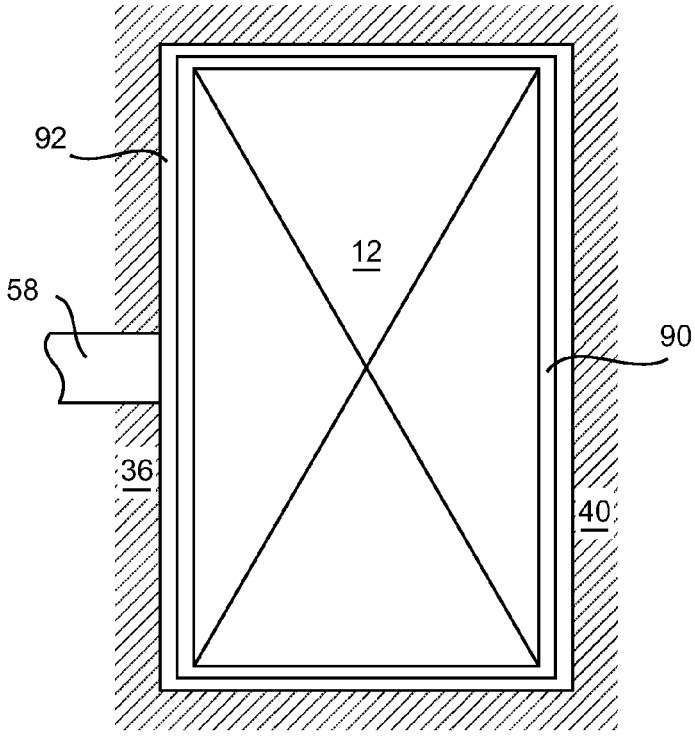
FIG. 5 is a sectional view of an embodiment of a magnetic coil and surrounding structure in the magnetic yoke.

As shown in FIG. 5, each coil 12/14 is covered by a ground wrap additional outer layer of epoxy-glass composite 90 and a thermal overwrap of tape-foil sheets 92 formed, e.g., of copper or aluminum. The thermal overwrap 92 is in thermal contact with both the low-temperature conductive link 58 for cryogenic cooling and with the pole 38/40 and return yoke 36, though contact with between the thermal overwrap 92 and the pole 38/40 and return yoke 36 may or may not be over the entire surface of the overwrap 92 (e.g., direct- or indirect-contact may be only at a limited number of contact areas on the adjacent surfaces). Characterization of the low-temperature conductive link 58 and the yoke 20 being in "thermal contact" means that there is direct contact between the conductive link 58 and the yoke or that there is physical contact through one or more thermally conductive intervening materials [e.g., having a thermal conductivity of at least about 1 W/(m·K)], such as a thermally conductive filler material of suitable differential thermal contraction that can be mounted between and flush with the thermal overwrap 92 and the low-temperature conductive link 58 to accommodate differences in thermal expansion between these components with cooling and warming of the magnet structure.

The low-temperature conductive link 58, in turn, is thermally coupled with a cryocooler thermal link 37 (shown in FIGS. 1 and 2), which, in turn, is thermally coupled with the cryocooler 26 (shown in FIG. 3). Accordingly, the thermal overwrap 92 provides thermal contact among the cryocooler 26, the yoke 20 and the coils 12 and 14.

Finally, a filler material of suitable differential thermal contraction can be mounted between and flush with the thermal overwrap 92 and the low-temperature conductive link 58 to accommodate differences in thermal expansion between these components with cooling and warming of the magnet structure.

The magnetic coils 12 and 14 surround the acceleration chamber 46 (as shown in FIG. 1), which contains the beam chamber 64, on opposite sides of the median acceleration plane 18 (see FIG. 3) and serve to directly generate extremely high magnetic fields in the median acceleration plane 18. When activated via an applied voltage, the magnetic coils 12 and 14 further magnetize the yoke 20 so that the yoke 20 also produces a magnetic field, which can be viewed as being distinct from the field directly generated by the magnetic coils 12 and 14.

The magnetic coils 12 and 14 are symmetrically arranged about a central axis 16 equidistant above and below the acceleration plane 18 in which the ions are accelerated. The magnetic coils 12 and 14 are separated by a sufficient distance to allow for at least one RF acceleration electrode 48 and a surrounding super-insulation layer 30 to extend there between in the acceleration chamber 46. Each coil 12/14 includes a continuous path of conductor material that is superconducting at the designed operating temperature, generally in the range of 4-30K, but also may be operated below 2K, where additional superconducting performance and margin is available. Where the cyclotron is to be operated at higher temperatures, superconductors such as bismuth strontium calcium copper oxide (BSCCO), yttrium barium copper oxide (YBCO) or $MgB_2$ can be used.

The outer radius of each coil is about 1.2 times the outer radius reached by the ions before the ions are extracted. For a magnetic field greater than 6 T, ions accelerated to 10 MeV are extracted at a radius of about 7 cm, while ions accelerated to 25 MeV are extracted at a radius of about 11 cm. Accordingly, a compact cold cyclotron of this disclosure designed to produce a 10-MeV beam can have an outer coil radius of about 8.4 cm, while a compact cold cyclotron of this disclosure designed to produce a 25-MeV beam can have an outer coil radius of about 13.2 cm.

The magnetic coils 12 and 14 comprise superconductor cable or cable-in-channel conductor with individual cable strands having a diameter of 0.6 mm and wound to provide a current carrying capacity of, e.g., between 2 million to 3 million total amps-turns. In one embodiment, where each strand has a superconducting current-carrying capacity of 2,000 amperes, 1,500 windings of the strand are provided in the coil to provide a capacity of 3 million amps-turns in the coil. In general, the coil can be designed with as many windings as are needed to produce the number of amps-turns needed for a desired magnetic field level without exceeding the critical current carrying capacity of the superconducting strand. The superconducting material can be a low-temperature superconductor, such as niobium titanium (NbTi), niobium tin ($Nb_3Sn$), or niobium aluminum ($Nb_3Al$); in particular embodiments, the superconducting material is a type II superconductor—in particular, $Nb_3Sn$ having a type A15 crystal structure. High-temperature superconductors, such as $Ba_2Sr_2Ca_1Cu_2O_8$, $Ba_2Sr_2Ca_2Cu_3O_{10}$, $MgB_2$ or $YBa_2Cu_3O_{7-x}$, can also be used.

The coils can be formed directly from cables of superconductors or cable-in-channel conductors. In the case of niobium tin, unreacted strands of niobium and tin (in a 3:1 molar ratio) may also be wound into cables. The cables are then heated to a temperature of about 650° C. to react the niobium and tin to form $Nb_3Sn$. The $Nb_3Sn$ cables are then soldered into a U-shaped copper channel to form a composite conductor. The copper channel provides mechanical support, thermal stability during quench; and a conductive pathway for the current when the superconducting material is normal (i.e., not superconducting). The composite conductor is then wrapped in glass fibers and then wound in an outward overlay. Strip heaters formed, e.g., of stainless steel can also be inserted between wound layers of the composite conductor to provide for rapid heating when the magnet is quenched and also to provide for temperature balancing across the radial cross-section of the coil after a quench has occurred, to minimize thermal and mechanical stresses that may damage the coils. After winding, a vacuum is applied, and the wound composite conductor structure is impregnated with epoxy to form a fiber/epoxy composite filler in the final coil structure. The resultant epoxy-glass composite in which the wound composite conductor is embedded provides electrical insulation and mechanical rigidity. Features of these magnetic coils and their construction are further described and illustrated in U.S. Pat. No. 7,696,847 B2 and in U.S. Patent Application Publication No. 2010/0148895 A1.

With the high magnetic fields, the magnet structure can be made exceptionally small. In one embodiment, the outer radius of the magnetic yoke 20 is about two times the radius, r, from the central axis 16 to the inner edge of the magnetic coils 12 and 14, while the height of the magnetic yoke 20 (measured parallel to the central axis 16) is about three times the radius, r.

Together, the magnetic coils 12 and 14 and the yoke 20 generate a combined field, e.g., of about 8 Tesla in the median acceleration plane 18. The magnetic coils 12 and 14 generate a majority of the magnetic field in the median acceleration plane, e.g., at least about 3 Tesla or more when a voltage is applied thereto to initiate and maintain a continuous electric current flow through the magnetic coils 12 and 14. The yoke 20 is magnetized by the field generated by the magnetic coils 12 and 14 and can contribute up to about another 2.5 Tesla to the magnetic field generated in the chamber for ion acceleration.

Both of the magnetic field components (i.e., both the field component generated directly from the coils 12 and 14 and the field component generated by the magnetized yoke 20) pass through the median acceleration plane 18 approximately orthogonal to the median acceleration plane 18. The magnetic field generated by the fully magnetized yoke 20 at the median acceleration plane 18 in the chamber, however, is much smaller than the magnetic field generated directly by the magnetic coils 12 and 14 at the median acceleration plane 18.

Figure 6:
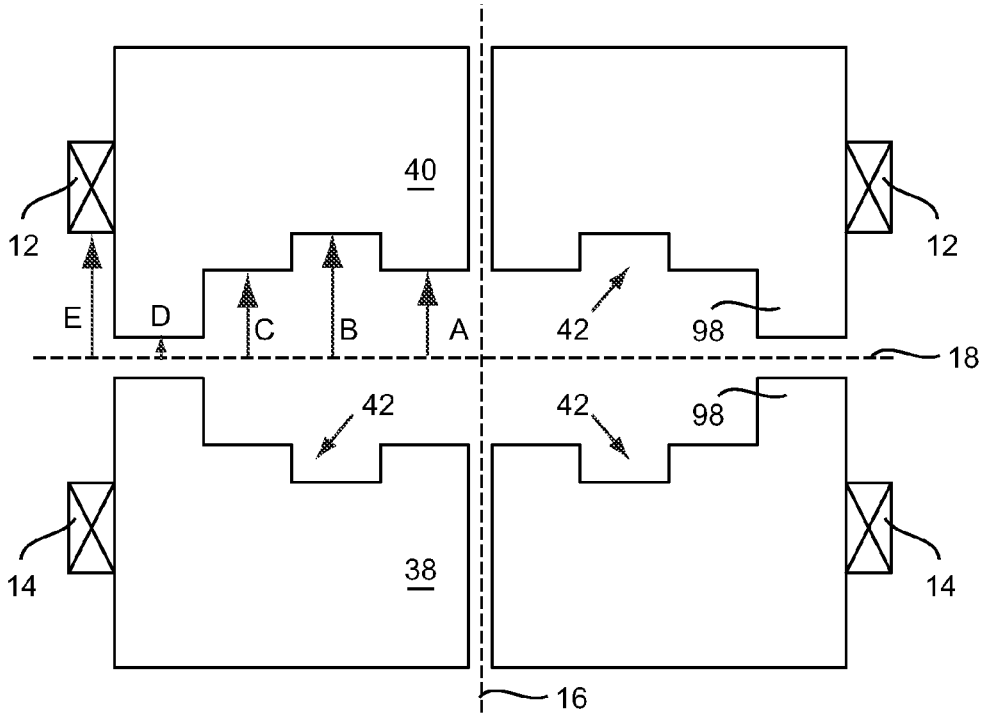
FIG. 6 is a sectional view of an embodiment of the yoke and the coils showing a custom inner pole profile.
Figure 7:
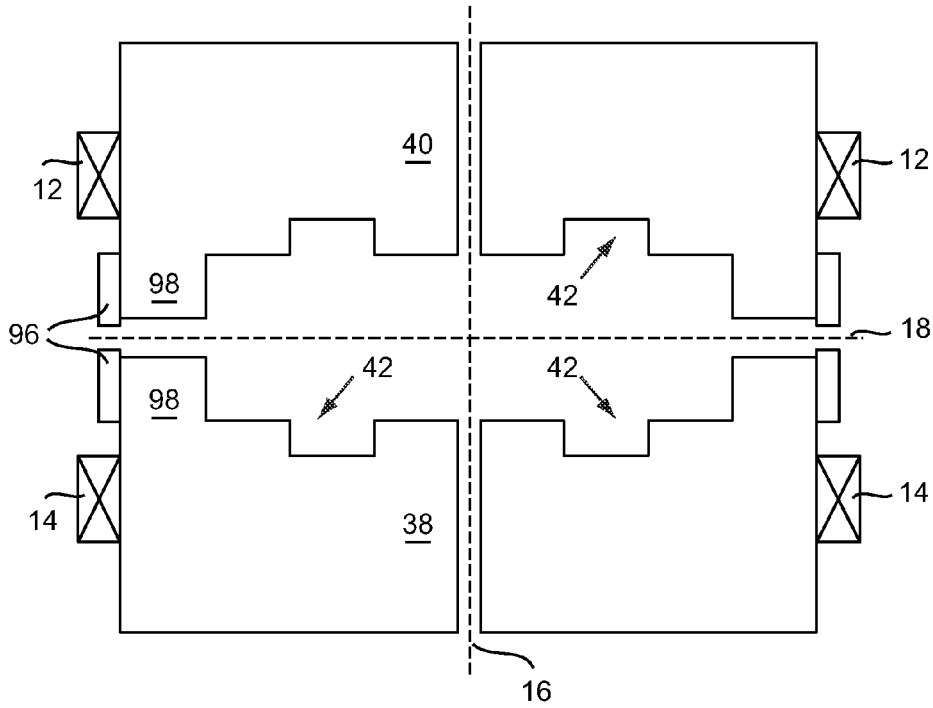
FIG. 7 is a sectional view of a magnet structure, wherein the poles of the yoke have the pole profile of FIG. 6 as well as magnetic tabs for providing magnetic field compensation at the vacuum feed-through port.

The magnet structure 10 is configured (by shaping the inner surfaces 42 of poles 38 and 40 or by providing additional magnetic coils to produce an opposing magnetic field in the acceleration chamber 46 or by a combination thereof) to shape the magnetic field along the median acceleration plane 18 so that the magnetic field decreases with increasing radius from the central axis 16 to the radius at which ions are extracted in the acceleration chamber 46 to enable classical-cyclotron ion acceleration. An embodiment of the tapered inner pole surfaces 42 with four stages (A, B, C and D) for shaping the magnetic field in the median acceleration plane is shown in FIG. 6, which is further discussed, infra.

The magnet structure 10 is also designed to provide weak focusing and phase stability in the acceleration of charged particles (ions) in the acceleration chamber 46. Weak focusing maintains the charged particles in space while they accelerate in an outward spiral through the magnetic field. Phase stability ensures that the charged particles gain sufficient energy to maintain the desired acceleration in the chamber. Specifically, more voltage than is needed to maintain ion acceleration is provided at all times via an electrically conductive conduit 68 to the high-voltage electrode 48 in a beam chamber 64 inside the acceleration chamber 46; and the yoke 20 is configured to provide adequate space in the acceleration chamber 46 for the beam chamber 64 and for the electrode 48. Where one electrode 48 is used, a ground (which may be referred to as a "dummy dee") is positioned at 180° relative to the electrode 48. In alternative embodiments, two electrodes (spaced 180° apart about the central axis 16, with grounds spaced at 90° C. from the electrodes) can be used. The use of two electrodes can produce higher gain per turn of the orbiting ion and better centering of the ion's orbit, reducing oscillation and producing a better beam quality.

During operation, the superconducting magnetic coils 12 and 14 can be maintained in a "dry" condition (i.e., not immersed in liquid refrigerant); rather, the magnetic coils 12 and 14 can be cooled to a temperature below the superconductor's critical temperature (e.g., as much as 5K below the critical temperature, or in some cases, less than 1K below the critical temperature) by one or more cryogenic refrigerators 26 (cryocoolers). When the magnetic coils 12 and 14 are cooled to cryogenic temperatures (e.g., in a range from 4K to 30K, depending on the composition), the yoke 20 is likewise cooled to approximately the same temperature due to the thermal contact among the cryocooler 26, the magnetic coils 12 and 14 and the yoke 20.

Figure 16:
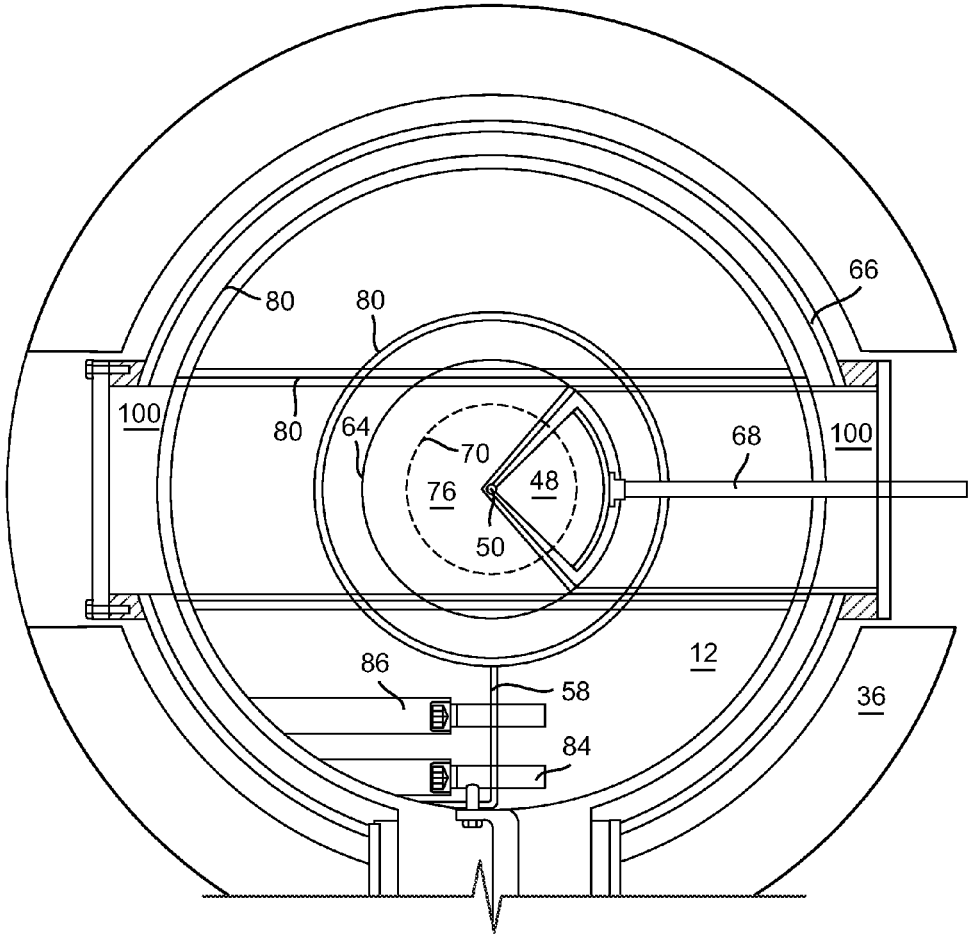
FIG. 16 is a top sectional view of an embodiment of the compact, cold, weak-focusing, superconducting cyclotron.

The cryocooler 26 can utilize compressed helium in a Gifford-McMahon refrigeration cycle or can be of a pulse-tube cryocooler design with a higher-temperature first stage 84 and a lower-temperature second stage 86. The lower-temperature second stage 86 of the cryocooler 26 can be operated at about 4.5 K and is thermally coupled via thermal links 37 and 58 with low-temperature-superconductor (e.g., NbTi) current leads 59 (shown in FIG. 16) that include wires that connect with opposite ends of the composite conductors in the superconducting magnetic coils 12 and 14 and with a voltage source to drive electric current through the coils 12 and 14. The cryocooler 26 can cool each low-temperature conductive link 58 and coil 12/14 to a temperature (e.g., about 4.5 K) at which the conductor in each coil is superconducting. Alternatively, where a higher-temperature superconductor is used, the second stage 86 of the cryocooler 26 can be operated at, e.g., 4-30 K. Accordingly, each coil 12/14 can be maintained in a dry condition (i.e., not immersed in liquid helium or other liquid refrigerant) during operation.

The warmer first stage 84 of the cryocooler 26 can be operated at a temperature of, e.g., 40-80 K and can be thermally coupled with a thermal shield 80 that is accordingly cooled to, e.g., about 40-80 K to provide an intermediate-temperature barrier between the magnet structure 10 and the cryostat 66, which can be at room temperature (e.g., at about 300 K). The volume defined by the cryostat 66 can be evacuated via a vacuum pump (not shown) to provide a high vacuum therein and thereby limit convection heat transfer between the cryostat 66, the intermediate thermal shield 80 and the magnet structure 10. The cryostat 66, thermal shield 80 and the magnet structure 10 are each spaced apart from each other an amount that minimizes conductive heat transfer and structurally supported by insulating spacers 82 (formed, e.g., of an epoxy-glass composite).

Use of the dry cryocooler 26 allows for operation of the cyclotron away from sources of cryogenic cooling fluid, such as in isolated treatment rooms or on moving platforms. Where a pair of cryocoolers 26 are provided permit, the cyclotron can continue operation even if one of the cryocoolers fails.

The magnetic yoke 20 comprises a ferromagnetic structure that provides a magnetic circuit that carries the magnetic flux generated by the superconducting coils 12 and 14 to the acceleration chamber 46. The magnetic circuit through the magnetic yoke 20 also provides field shaping for weak focusing of ions in the acceleration chamber 46. The magnetic circuit also enhances the magnetic field levels in the acceleration chamber 46 by containing most of the magnetic flux in the outer part of the magnetic circuit. The magnetic yoke 20 can be formed of low-carbon steel, and it surrounds the coils 12 and 14 and an inner super-insulation layer 30 (shown in FIG. 4 and formed, e.g., of aluminized mylar and paper) that surrounds the beam chamber 64. Pure iron may be too weak and may possess an elastic modulus that is too low; consequently, the iron can be doped with a sufficient quantity of carbon and other elements to provide adequate strength or to render it less stiff while retaining the desired magnetic levels. The magnetic yoke 20 circumscribes the same segment of the central axis 16 that is circumscribed by the coils 12 and 14 and the super-insulation layer 30.

The magnetic yoke 20 further includes a pair of poles 38 and 40 exhibiting approximate mirror symmetry across the median acceleration plane 18. The poles 38 and 40 are joined at the perimeter of the magnetic yoke 20 by a return yoke 36. The magnetic yoke 20 exhibits approximate rotational symmetry about the central axis 16, except allowing for discrete ports (such as the beam-extraction passage 60 and the vacuum feed-through port 100) and other discrete features at particular locations, as described or illustrated elsewhere herein, and except providing a saddle-like contour with additional magnetic tabs 96 (shown in FIGS. 7-15 and formed, e.g., of iron) at the vacuum feed-through port 100 (shown in FIG. 16), to narrow the pole separation gap at the feed-through port 100 and thereby balance less iron in the yoke 20 where a void is created by the feed-through port 100. In alternative embodiments, the magnetic tabs 96 are incorporated into a continuous belt that wraps around the perimeter of the yoke 20.

Figure 8:
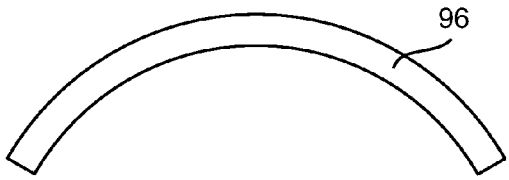
FIGS. 8-10 provide views of a first embodiment of the magnetic tab that is positioned along the outside of the pole wing.
Figure 9:
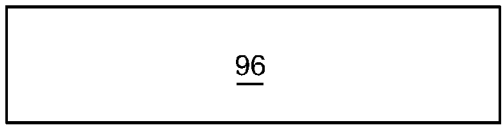
Figure 10:
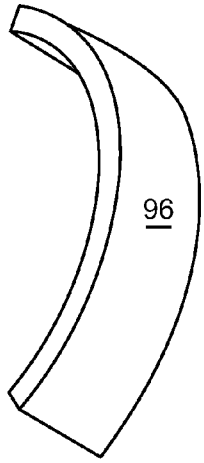
Figure 11:
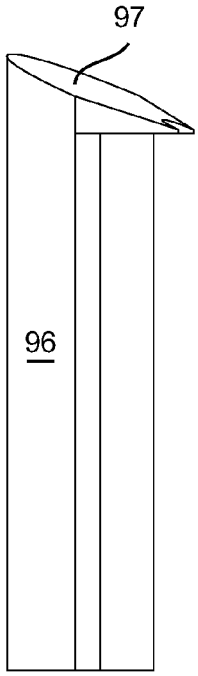
FIGS. 11-15 provide views of a second embodiment of the magnetic tab that is positioned along the outside of the pole wing and also wraps around the inner surface of the pole wing.
Figure 12:
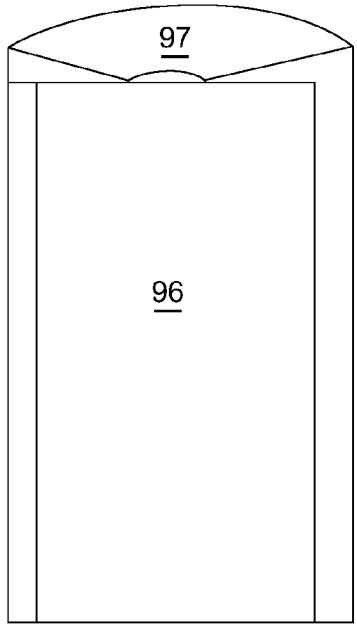
Figure 13:
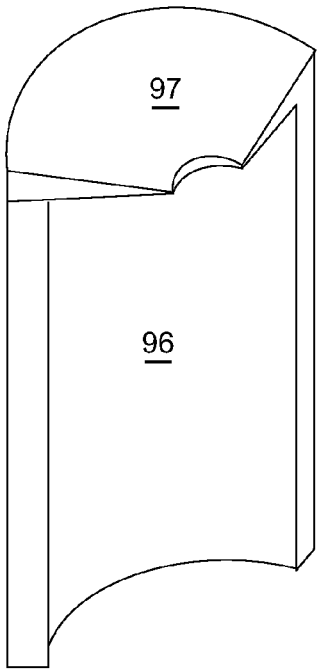
Figure 14:
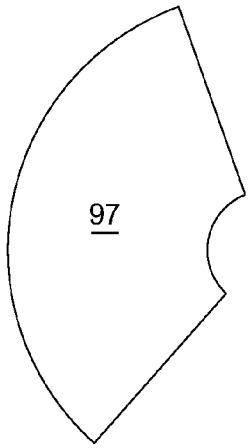
Figure 15:
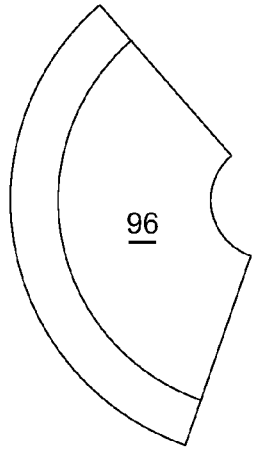

A first embodiment of the tab 96 is in the form of a curved strip, as shown in FIGS. 8-10; FIGS. 8 and 9 respectively provide views (relative to the orientation of FIG. 7) from the top and side, while FIG. 10 provides a perspective view of a tab 96. A second embodiment of the tab 96, this time in the form of a curved strip, as in the first embodiment, though also including a tapered cover section 97 that extends over the surface of the pole wing 98 that faces inward toward the median acceleration plane 18. In this embodiment, the height of the tapered cover section 97 progressively narrows across the surface of the pole wing 98 as the distance to the central axis 16 decreases. Relative to the orientation of the lower pole 38, the tab 96 with the tapered cover section 97 is shown from the side in FIG. 11, from the central axis 16 in FIG. 12, from the top and bottom respectively from FIGS. 14 and 15, while a perspective view of this embodiment of the tab 96 is provided in FIG. 13.

The poles 38 and 40 have tapered inner surfaces 42, shown in FIG. 6, that jointly define a pole gap between the poles 38 and 40 and across the acceleration chamber 46. The profiles of the tapered inner surfaces 42 are a function of the position of the coils 12 and 14 and as a function of distance from the central axis 16 such that the distance from the median acceleration plane 18 is greatest (e.g., 3.5 cm) at stage B, between opposing surfaces 42, where expansion of this pole gap provides for sufficient weak focusing and phase stability of the accelerated ions.

The distance of the inner pole surface 42 from the median acceleration plane 18 is at a median of, e.g., 2.5 cm both immediately adjacent the central axis at stage A and beyond stage B at stage C. This distance narrows to, e.g., 0.8 cm at the pole wings 94 in stage D, to provide for weak focusing against the deleterious effects of the strong superconducting coils, while properly positioning the full energy beam near the pole edge for extraction. In this embodiment, the near surfaces of coils 12 and 14 at stage E are spaced 3.5 cm above/below the median acceleration plane 18. In alternative embodiments, the stages A-D are not discrete and instead are tapered to provide a continuous smooth slope transitioning from one stage to the next. In another alternative design, more or fewer than four stages are provided across the inner pole surfaces 42.

Stages A, B, C and D radially extend along the median acceleration plane 18 from the central axis 16 across substantially equal distances, wherein each of A, B, C, and D extends across about one quarter of the distance from the central axis 16 to the inner surface of the coils 12/14 (or slightly less than one quarter to accommodate the passage along the central axis for insertion of the ion source). For example, where the radius from the central axis 16 to the inner radius of the coils 12/14 is 10 cm, each stage radially extends across a distance of about 2.5 cm parallel to the median acceleration plane. In this embodiment, the stages are discrete, though in alternative embodiments, the stages can be sloped and tapered, providing smooth transitions between stages on the pole surfaces.

This pole geometry can be used for a broad range of acceleration operations, with energy levels for the accelerated particles ranging, for example, at any level from 3.5 MeV to 25 MeV. The pole profile thus described has several acceleration functions, namely, ion guiding at low energy in the center of the machine, capture into stable acceleration paths, acceleration, axial and radial focusing, beam quality, beam loss minimization, attainment of the final desired energy and intensity, and the positioning of the final beam location for extraction. In particular, the simultaneous attainment of weak focusing and acceleration phase stability is achieved.

The magnetic yoke 20 also provides at least one radial passage, such as the vacuum feed-through port 100 (shown in FIG. 16), and sufficient clearance for insertion into the acceleration chamber 46 of a resonator structure including the radiofrequency (RF) accelerator electrode 48, which is formed of a conductive metal. The accelerator electrode 48 includes a pair of flat semi-circular parallel plates that are oriented parallel to and above and below the acceleration plane 18 inside the acceleration chamber 46 (as described and illustrated in U.S. Pat. Nos. 4,641,057 and 7,696,847). Ions can be generated by an internal ion source 50 positioned proximate the central axis 16 or can be provided by an external ion source via an ion-injection structure. An example of an internal ion source 50 can be, for example, a heated cathode coupled to a voltage source and proximate to a source of hydrogen gas.

The accelerator electrode 48 is coupled via an electrically conductive pathway with a radiofrequency voltage source that generates a fixed-frequency oscillating electric field to accelerate emitted ions from the ion source 50 in an expanding spiral orbit in the acceleration chamber 46. In particular embodiments, wherein the cyclotron operates in a synchrocyclotron mode, the radiofrequency voltage source can be set by a radiofrequency rotating capacitor to provide variable frequency such that the frequency of the electric field decreases as the ion spirals outward in the median acceleration plane.

Figure 4:
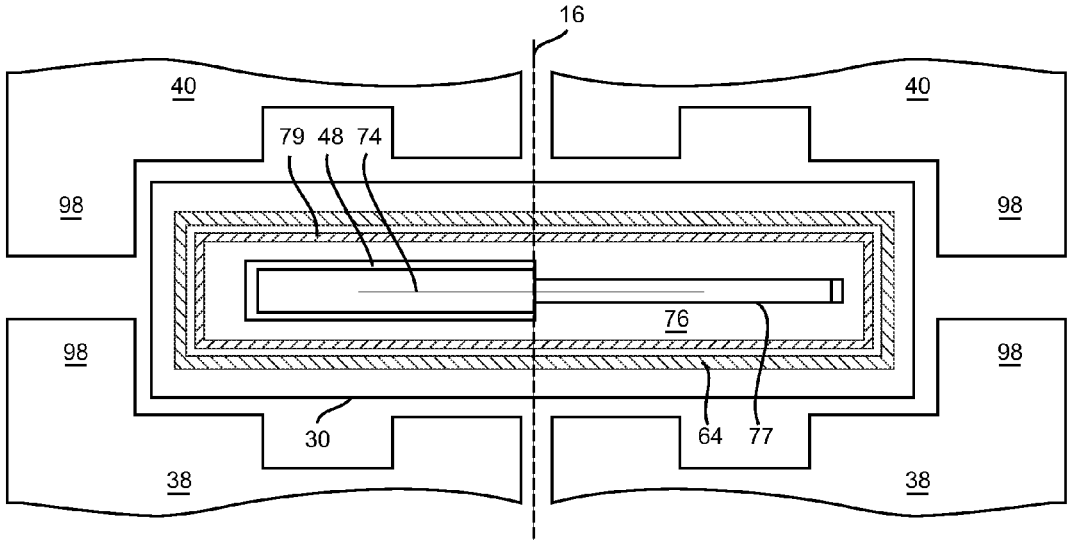
FIG. 4 is a partially sectioned view of an embodiment of a beam chamber within an inner cryostat inside the acceleration chamber between the poles.

Inside the acceleration chamber 46, the beam chamber 64 and the dee electrode 48 reside inside the inner super-insulation structure 30, as shown in FIG. 4, that provides thermal insulation between the electrode 48, which emits heat, and the cryogenically cooled magnetic yoke 20. The electrode 48 can accordingly operate at a temperature at least 40K higher than the temperature of the magnetic yoke 20 and the superconducting coils 12 and 14. The illustration of FIG. 4 is split, wherein an inside section showing the dee electrode 48 is provided to the left of the central axis 16 and an outside view of the ground (dummy dee) 76, including an inner face 77 and an outer electrical ground plate 79 (in the form, e.g., of a copper liner) is provided to the right of the central axis 16.

The acceleration-system beam chamber 64 and dee electrode 48 can be sized, for example, to produce a 20-MeV proton beam (charge=1, mass=1) at an acceleration voltage, $V_o$, of less than 20 kV. The beam chamber 64 can define a cylindrical volume having, e.g., a height of 3 cm and a diameter of 16 cm. The ferromagnetic iron poles and return yoke are designed as a split structure to facilitate assembly and maintenance; the yoke has an outer radius of about twice the radius, $r_p$, of the poles from the central axis 16 to the coils 12/14 (e.g., about 20 cm, where $r_p$ is 10 cm) or less, a total height of about $3r_p$ (e.g., about 30 cm, where $r_p$ is 10 cm), and a total mass less than 2 tons (~2000 kg).

Accelerated in the magnetic field generated by the magnetic coils 12, 14 and the magnetic yoke 20, ions have an average trajectory in the form of a spiral orbit 74 expanding along a radius, r, from the central axis 16. The ions also undergo small orthogonal oscillations around this average trajectory. These small oscillations about the average radius are known as betatron oscillations, and they define particular characteristics of accelerating ions.

Upper and lower pole wings 98 sharpen the magnetic field edge for extraction by moving the characteristic orbit resonance, which sets the final obtainable energy closer to the pole edge. The upper and lower pole wings 98 additionally serve to shield the internal acceleration field from the strong split coil pair 12 and 14. Regenerative ion extraction or self-extraction can be accommodated by providing additional localized pieces of ferromagnetic upper and lower iron tips to be placed circumferentially around the face of the upper and lower pole wings 98 to establish a sufficient localized non-axi-symmetric edge field.

In operation, a voltage (e.g., sufficient to generate 2,000 A of current in the embodiment with 1,500 windings in the coil, described above) can be applied to each coil 12/14 via the current lead in conductive link 58 to generate a magnetic field of, for example, at least 8 Tesla within the acceleration chamber 46 when the coils are at 4.5 K. In other embodiments, a greater number of coil windings can be provided, and the current can be reduced. The magnetic field includes a contribution of up to about 2.5 Tesla from the fully magnetized iron poles 38 and 40; the remainder of the magnetic field is produced by the coils 12 and 14.

This magnet structure 10 serves to generate a magnetic field sufficient for ion acceleration. Pulses of ions can be generated by the ion source, e.g., by applying a voltage pulse to a heated cathode to cause electrons to be discharged from the cathode into hydrogen gas; wherein, protons are emitted when the electrons collide with the hydrogen molecules. Though the acceleration chamber 46 is evacuated to a vacuum pressure of, e.g., less than $10^{-3}$ atmosphere, hydrogen is admitted and regulated in an amount that enables maintenance of the low pressure, while still providing a sufficient number of molecules for production of a sufficient number of protons. As alternatives to protons, other ions with a heavier mass, such as deuterons or alpha particles all the way up to much heavier ions, such as uranium, can be accelerated with these apparatus and methods; in operation, the frequency of the electric field can be decreased for heavier elements. During operation, the electrode 48 and other components inside the inner cryostat can be at a relatively warm temperature (e.g., around 300K or at least 40K higher than the temperature of the magnetic yoke 20 and superconducting coils 12 and 14).

In this embodiment, the voltage source (e.g., a high-frequency oscillating circuit) maintains an alternating or oscillating potential difference of, e.g., 20,000 Volts across the plates of the RF accelerator electrode 48. The electric field generated by the RF accelerator electrodes 48 has a fixed frequency (e.g., 140 MHz) matching that of the cyclotron orbital frequency of the proton ion to be accelerated. The electric field produced by the electrode 48 produces a focusing action that keeps the ions traveling approximately in the central part of the region of the interior of the plates, and the electric-field impulses provided by the electrode 48 to the ions cumulatively increase the speed of the emitted and orbiting ions. As the ions are thereby accelerated in their orbit, the ions spiral outward from the central axis 16 in successive revolutions in resonance or synchronicity with the oscillations in the electric fields.

Specifically, the electrode 48 has a charge opposite that of the orbiting ion when the ion is away from the electrode 48 to draw the ion in its arched path toward the electrode 48 via an opposite-charge attraction. The electrode 48 is provided with a charge of the same sign as that of the ion when the ion is passing between its plates to send the ion back away in its orbit via a same-charge repulsion; and the cycle is repeated. Under the influence of the strong magnetic field at right angles to its path, the ion is directed in a spiraling path through the electrode 48 and the ground 76. As the ion gradually spirals outward, the velocity of the ion increases proportionally to the increase in radius of its orbit, until the ion eventually reaches an outer radius 70 at which it is magnetically deflected by a magnetic deflector system (e.g., in the form of iron tips positioned about the perimeter of the acceleration chamber 46) into a collector channel to allow the ion to deviate outwardly from the magnetic field and to be withdrawn from the cyclotron (in the form of a pulsed beam) into a linear beam-extraction passage 60 extending from the acceleration chamber 46 through the return yoke 36 toward, e.g., an external target.

In describing embodiments of the invention, specific terminology is used for the sake of clarity. For the purpose of description, specific terms are intended to at least include technical and functional equivalents that operate in a similar manner to accomplish a similar result. Additionally, in some instances where a particular embodiment of the invention includes a plurality of system elements or method steps, those elements or steps may be replaced with a single element or step; likewise, a single element or step may be replaced with a plurality of elements or steps that serve the same purpose. Further, where parameters for various properties are specified herein for embodiments of the invention, those parameters can be adjusted up or down by $1/100^{th}$, $1/50^{th}$, $1/20^{th}$, $1/10^{th}$, $1/5^{th}$, $1/3^{rd}$, 1/2, $3/4^{th}$, etc. (or up by a factor of 2, 5, 10, etc.), or by rounded-off approximations thereof, unless otherwise specified. Moreover, while this invention has been shown and described with references to particular embodiments thereof, those skilled in the art will understand that various substitutions and alterations in form and details may be made therein without departing from the scope of the invention. Further still, other aspects, functions and advantages are also within the scope of the invention; and all embodiments of the invention need not necessarily achieve all of the advantages or possess all of the characteristics described above. Additionally, steps, elements and features discussed herein in connection with one embodiment can likewise be used in conjunction with other embodiments. The contents of references, including reference texts, journal articles, patents, patent applications, etc., cited throughout the text are hereby incorporated by reference in their entirety; and appropriate components, steps, and characterizations from these references optionally may or may not be included in embodiments of this invention. Still further, the components and steps identified in the Background section are integral to this disclosure and can be used in conjunction with or substituted for components and steps described elsewhere in the disclosure within the scope of the invention. In method claims, where stages are recited in a particular order—with or without sequenced prefacing characters added for ease of reference—the stages are not to be interpreted as being temporally limited to the order in which they are recited unless otherwise specified or implied by the terms and phrasing.

What is claimed is:

1. A compact, cold, weak-focusing superconducting cyclotron comprising:

at least two superconducting coils, centered around a central axis with outer surfaces remote from the central axis, wherein the coils are on opposite sides of a median acceleration plane and have opposed median-acceleration-plane-facing surfaces;

a magnetic yoke surrounding the coils and in physical contact with the coils across the outer surface of each coil and across the median-acceleration-plane-facing surface of each coil to substantially reduce or eliminate strain on the coils due to decentering forces and without an intervening cryostat between the magnetic yoke and the coils, wherein the magnetic yoke contains an acceleration chamber, wherein the magnetic yoke is in thermal contact with the superconducting coils, wherein the median acceleration plane extends through the acceleration chamber, and wherein the superconducting coils and the physically coupled magnetic yoke are configured to generate a magnetic field that reaches at least 6 Tesla in the median acceleration plane;

a cryogenic refrigerator physically and thermally coupled with the superconducting coils and with the magnetic yoke; and a cryostat mounted outside the magnetic yoke and containing the coils and the magnetic yoke inside a thermally insulated volume in which the coils and the magnetic yoke can be maintained at cryogenic temperatures by the cryogenic refrigerator.

2. The cyclotron of claim 1, wherein the superconducting coils are physically supported by the magnetic yoke.

3. The cyclotron of claim 1, further comprising a pair of electrodes coupled with a radiofrequency voltage source and mounted in the acceleration chamber to accelerate ions orbiting in the acceleration chamber.

4. The cyclotron of claim 3, further comprising a thermally insulating structure separating the electrodes from the magnetic yoke and the superconducting coils.

5. The cyclotron of claim 1, wherein the magnetic yoke includes a pair of poles on opposite sides of the median acceleration plane, wherein each pole is structured to produce a radially decreasing magnetic field across the median acceleration plane from an inner radius for ion introduction to an outer radius for ion extraction.

6. The cyclotron of claim 5, wherein the magnetic yoke includes a radially extending vacuum feed-through port providing access through the magnetic yoke to the acceleration chamber, and wherein a separation gap between the poles decreases over the vacuum feed-through port.

7. The cyclotron of claim 5, wherein the poles extend radially about 10 cm from a central axis to the superconducting coils.

8. The cyclotron of claim 7, wherein each pole has a profile including stages that can be designated A, B, C and D, wherein stages A, B, C and D extend radially outward from a central axis in alphabetical order, and wherein the poles are separated by about 7 cm at stage B.

9. The cyclotron of claim 8, wherein the poles are separated by about 1.6 cm at stage D.

10. The cyclotron of claim 9, wherein the poles are separated by about 5 cm at each of stages A and C.

11. The cyclotron of claim 10, wherein the superconducting coils are separated by about 7 cm.

12. The cyclotron of claim 11, wherein each of stages A, B, C and D extend across a radial distance from the central axis that is substantially the same as the radial distance over with the other stages extend.

13. The cyclotron of claim 5, wherein the magnetic yoke is structured to contribute no more than 2.5 Tesla to the median acceleration plane when the magnetic yoke is fully magnetized.

14. The cyclotron of claim 13, wherein the superconducting coils are structured to contribute at least 3 Tesla to the median acceleration plane.

15. The cyclotron of claim 1, wherein the superconducting coils comprise a material that is superconducting at a temperature of at least 4 K.

16. The cyclotron of claim 1, wherein the magnetic yoke comprises iron.

17. A method for ion acceleration comprising: employing a cyclotron comprising:

a) at least two superconducting coils, centered around a central axis with outer surfaces remote from the central axis, wherein the coils are on opposite sides of a median acceleration plane and have opposed median-acceleration-plane-facing surfaces;

b) a magnetic yoke surrounding the coils, and in physical contact with the coils across the outer surface of each coil and across the median-acceleration-plane-facing surface of each coil to substantially reduce or eliminate strain on the coils due to decentering forces and without an intervening cryostat between the magnetic yoke and the coils, wherein the magnetic yoke contains an acceleration chamber, wherein the magnetic yoke is in thermal contact with the superconducting coils, wherein the median acceleration plane extends through the acceleration chamber, and wherein the superconducting coils and the physically coupled magnetic yoke are configured to generate a magnetic field that reaches at least 6 Tesla in the median acceleration plane;

c) a cryogenic refrigerator physically and thermally coupled with the superconducting coils and with the magnetic yoke;

d) an electrode coupled with a radiofrequency voltage source and mounted in the acceleration chamber; and e) a cryostat mounted outside the magnetic yoke and containing the coils and the magnetic yoke;

introducing an ion into the median acceleration plane at an inner radius;

providing a radiofrequency voltage from the radiofrequency voltage source to the electrode to accelerate the ion in an expanding orbit across the median acceleration plane;

cooling the superconducting coils and the magnetic yoke with the cryogenic refrigerator, wherein the superconducting coils are cooled to a temperature no greater than their superconducting transition temperature, and wherein the magnetic yoke is cooled to a temperature no greater than 100 K;

providing a voltage to the cooled superconducting coils to generate a superconducting current in the superconducting coils that produces a magnetic field reaching at least 6 Tesla in the median acceleration plane from the superconducting coils and from the yoke; and extracting the accelerated ion from acceleration chamber at an outer radius.

18. The method of claim 17, wherein the electrode is maintained at a temperature at least 40 K higher than the magnetic yoke and the superconducting coils.

19. The method of claim 17, wherein the magnetic field produced in the median acceleration plane decreases with radius from the inner radius for ion introduction to the outer radius for ion extraction.

20. The method of claim 17, wherein the magnetic field produced in the median acceleration plane reaches at least 8 Tesla.

21. The method of claim 20, wherein at least 5 Tesla of the field of at least 8 Tesla is produced by the superconducting coils.

22. The method of claim 17, wherein the superconducting coils are centered about a central axis, and wherein the produced magnetic field is substantially axially symmetric about the central axis from the inner radius for ion introduction to the outer radius for ion extraction.

23. The method of claim 17, wherein the ion is accelerated at a fixed frequency from the inner radius for ion introduction to the outer radius for ion extraction.

24. A cyclotron positioned about a central axis, the cyclotron comprising:

an ion source at an inner radius from the central axis for introducing into an acceleration chamber an ion to be accelerated by the cyclotron in a median acceleration plane inside the acceleration chamber;

an ion extraction apparatus at an outer radius from the central axis for extracting the ion from the acceleration chamber;

an electrode including a pair of plates, one on each side of the median acceleration plane for orbitally accelerating the ion from the inner radius to the outer radius;

a pair of electrically conductive coils centered about the central axis and configured to generate a magnetic field in the acceleration chamber;

a magnetic yoke surrounding the electrode and the electrically conductive coils and including a pair of poles joined at a perimeter and separated on opposite sides of the electrode across a pole gap, wherein the magnetic yoke defines a vacuum feed-through port that provides access to the electrode, and wherein the pole gap narrows at angles from the central axis that cross the vacuum feed-through port and expands at angles from the central axis that are away from the vacuum feed-through port; and an electrically conductive conduit that extends through the vacuum feed-through port and is coupled with the electrode.

* * * * *